US005335525A

United States Patent [19]

Solovieff

[11] Patent Number: 5,335,525

[45] Date of Patent: Aug. 9, 1994

[54] UNIVERSAL ADAPTOR FOR DEADBOLT

[75] Inventor: Paul G. Solovieff, Tustin, Calif.

[73] Assignee: Emhart Inc., Newark, Del.

[21] Appl. No.: 207,251

[22] Filed: Mar. 8, 1994

Related U.S. Application Data

[63] Continuation of Ser. No. 928,602, Aug. 13, 1992, abandoned.

[51] Int. Cl.[5] ..... E05B 9/08

[52] U.S. Cl. ..... 70/370; 70/451; 70/448

[58] Field of Search ..... 285/177; 70/370, 451, 70/448

[56] References Cited

U.S. PATENT DOCUMENTS

| | | | |
|---|---|---|---|
| 1,487,307 | 3/1924 | Best . | |
| 1,832,108 | 11/1931 | Falk . | |
| 1,866,342 | 7/1932 | Best . | |
| 1,964,787 | 7/1934 | Voight . | |
| 1,986,676 | 1/1935 | Hurd . | |
| 1,992,126 | 2/1935 | Hurd . | |
| 2,012,912 | 8/1935 | Hurd . | |
| 2,023,941 | 12/1935 | Voight . | |
| 2,061,456 | 11/1936 | Falk . | |
| 2,268,511 | 12/1941 | Ledin . | |
| 3,190,091 | 6/1965 | Russell et al. . | |
| 3,206,958 | 9/1965 | Best . | |
| 3,261,189 | 7/1966 | Best . | |
| 3,324,693 | 6/1967 | Check . | |
| 3,492,842 | 2/1970 | Schlage . | |
| 3,824,817 | 7/1974 | Orr . | |
| 3,905,213 | 9/1975 | Roberts . | |
| 3,934,437 | 1/1976 | Crepinsek | 70/370 |
| 4,012,928 | 3/1977 | Dauenbaugh . | |
| 4,099,397 | 7/1978 | Dauenbaugh . | |
| 4,143,531 | 3/1979 | Floyd . | |
| 4,158,952 | 6/1979 | Oliver et al. . | |
| 4,301,667 | 11/1981 | Best et al. . | |
| 4,320,637 | 3/1982 | Wu . | |
| 4,338,804 | 7/1982 | Solovieff | 70/134 |
| 4,398,405 | 8/1983 | Patriquin . | |
| 4,484,462 | 11/1984 | Berkowitz . | |
| 4,522,048 | 6/1985 | Davis | 70/417 |
| 4,559,795 | 12/1985 | Zagoroff . | |
| 4,561,212 | 12/1985 | Ullman, Jr. | 70/451 |
| 4,655,059 | 4/1987 | Best et al. . | |
| 4,672,827 | 6/1987 | Craig . | |
| 4,672,829 | 6/1987 | Gater et al. . | |
| 4,712,400 | 12/1987 | Steinbach . | |
| 4,715,201 | 12/1987 | Craig . | |
| 4,761,978 | 8/1988 | Walla . | |
| 4,765,163 | 8/1988 | Trull et al. . | |
| 4,809,525 | 3/1989 | Cox . | |
| 4,832,375 | 5/1989 | Emberson | 285/177 |
| 4,914,932 | 4/1990 | Walla . | |
| 4,995,249 | 2/1991 | Preissler et al. . | |
| 5,046,772 | 9/1991 | Su | 292/DIG. 53 |

FOREIGN PATENT DOCUMENTS

| | | |
|---|---|---|
| 723037 | 6/1942 | Fed. Rep. of Germany . |
| 752937 | 10/1933 | France . |

*Primary Examiner*—Peter M. Cuomo
*Assistant Examiner*—Darnell M. Boucher
*Attorney, Agent, or Firm*—J. Bruce Hoofnagle

[57] ABSTRACT

An adaptor 16 is formed with a pair of cylinders 22 and 24 which are in axial alignment, of different diameters and extend from opposite sides thereof. One of the cylinders 22 and 24 fits in complementary fashion into one of a pair holes 14 and 12, respectively, to preclude any movement in a radially lateral direction of adaptor 16 relative to the axis of the hole. The other one of cylinders 22 and 24 fits, respectively, into a groove 44 formed in a face 42 of a guard collar 18 or into a cylindrical opening 36 of the collar. The cylinders 22 and 24 are joined by integral links 26, 28 and 30 so that the precluding of radially lateral movement of the cylinder 22 or 24 within its hole 14 or 12, respectively, prevents radial movement of collar 18 relative to the axis of the hole.

14 Claims, 4 Drawing Sheets

UNIVERSAL ADAPTOR FOR DEADBOLT

This is a continuation of application Ser. No. 07/928,602, filed Aug. 13, 1992 now abandoned.

BACKGROUND OF THE INVENTION

This invention relates to a reversible adaptor for a deadbolt and particularly relates to an adaptor which facilitates the assembly of components of a deadbolt assembly with different size holes of a door.

In the past, doors have been prepared with a standard size hole in preparation for receipt of components of a deadbolt assembly. Typically, the hole had been formed with a diameter of one and one-half inches. Many doors with a hole of this size remain in use at site locations.

In recent years, the standard size of the hole has been increased to a diameter of two and one-eighth inches and the components which are assembled with the larger size hole are accordingly larger.

In the event that one has a door, in place, with the smaller size hole and they wish to install a new deadbolt with related components, they may encounter difficulty locating product which includes components for use with the smaller size hole. Thus, the opportunity to replace their deadbolt assembly may not be available.

Also, there may be situations where a new door has been prepared with the smaller size hole. Again, the hardware for the smaller size hole may not be available or, at best, difficult to locate.

In either situation, there is a need for a facility for allowing the assembly of components of a deadbolt assembly regardless of whether the door hole diameter is one and one-half inches or two and one-eighth inches.

SUMMARY OF THE INVENTION

In view of the need as expressed above, it is an object of this invention to provide facility for assembling components of a deadbolt assembly with door holes of different sizes.

Another object of this invention is to provide uniformity in the manufacture and supply of components of a deadbolt assembly for ultimate assembly to a door regardless of the size of the related hole of the door.

Still another object of this invention is to provide a facility which will allow assembly, with relative ease and simplicity, of components of a deadbolt assembly with a door regardless of the size of the related hole of the door.

With these and other objects in mind, this invention contemplates an adaptor for facilitating assembly of a component of a lock assembly with a door adjacent a hole formed in the door. Such an adaptor includes means positionable within the hole for precluding lateral movement of the adaptor relative to an axis of the hole. Other means are positionable adjacent the component for preventing lateral movement of the component relative to the preventing means. Still other means are provided for linking the precluding means and the preventing means whereby the component is prevented from moving laterally relative to the axis of the hole.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

In the past, in preparation for the assembly of a deadbolt assembly with a door, a hole having a diameter of one and one-half inches was formed through the door for receipt of components of complementary size. Doors with this hole size remain in use today at many installation sites.

In recent years, a larger hole size of two and one-eighth inches has been adapted with deadbolt assembly components being sized for complementary fit with the larger hole size.

As doors with the larger size hole become more prevalent, the availability of assemblies of the small size will be more difficult to locate in the marketplace.

Thus, replacement of deadlock assemblies for doors having the smaller hole will become difficult.

Further, in some sectors of door installation, the doors may arrive from the manufacturer with the smaller size hole formed therein. Similar difficulty could be encountered in locating deadbolt assemblies for assembly with the smaller holes.

Figure 1:
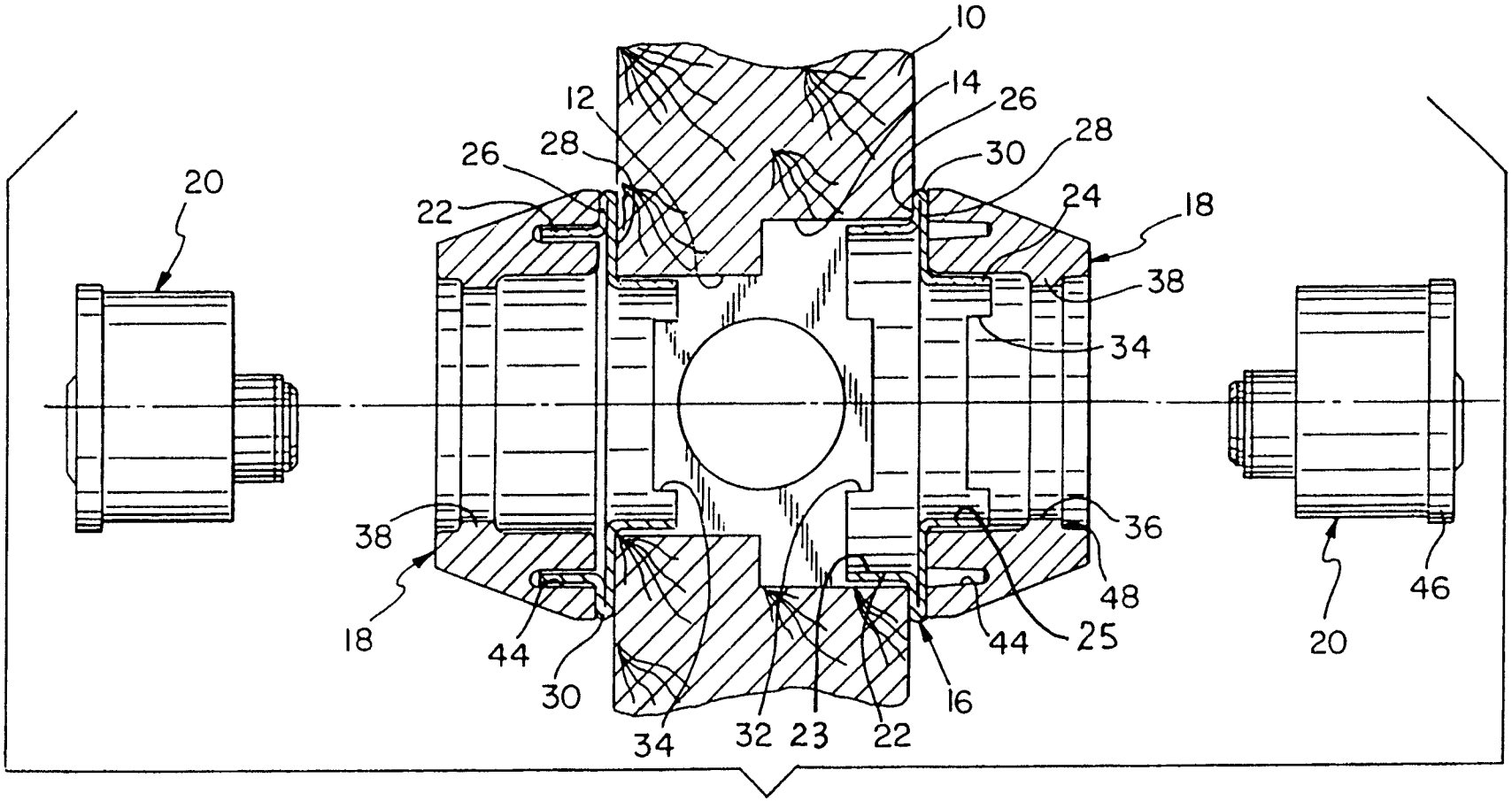
FIG. 1 is a partial sectional view showing a pair of adaptors assembled with a door and respective guard collars in accordance with certain principles of the invention.

As shown in FIG. 1, a door 10 is formed on the left side thereof with a hole 12 of the smaller diameter, i.e. one and one-half inches, and on the right side thereof with a hole 14 of the larger size, i.e. two and one-eighth inches. Normally, either hole 12 or hole 14 would extend fully through door 10 and is only being shown in FIG. 1 in this manner to illustrate the two hole sizes and the assembly of components therewith.

As further shown in FIG. 1, a reversible adaptor 16 is assembled within hole 12. Another reversible adaptor 16 is shown in assembly with hole 14. Each of the adaptors 16 shown in FIG. 1 is also assembled with a respective one of a pair of guard collars 18. Cylinder locks 20 are shown in position for subsequent insertion into guard collars 18 for retention therewith in the normal fashion.

Figure 4:
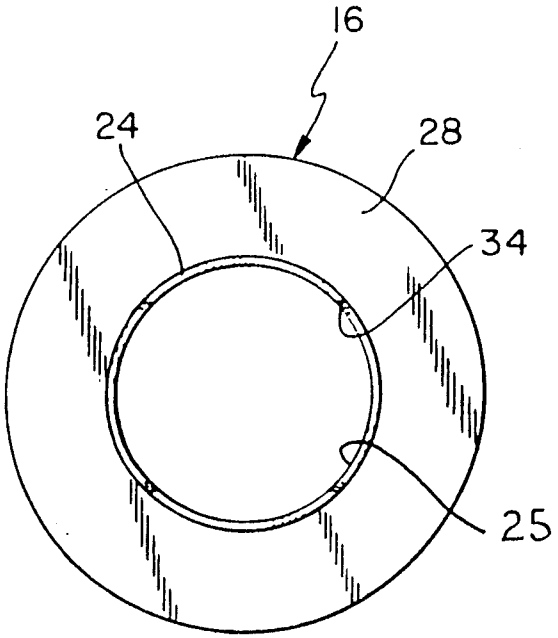
FIG. 4 is a rear view of the adaptor of FIG. 1 illustrating features thereof in accordance with certain principles of the invention.
Figure 3:
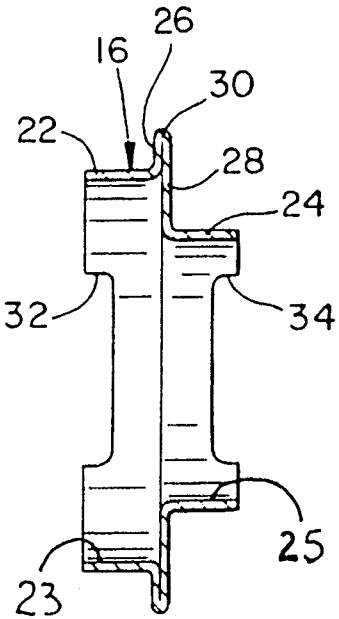
FIG. 3 is a sectional view taken along line 3—3 of FIG. 2 illustrating features of the adaptor of FIG. 1 in accordance with certain principles of the invention.
Figure 2:
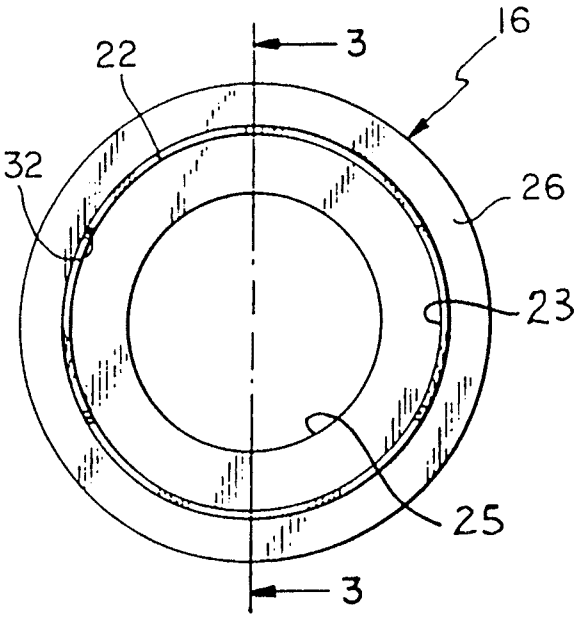
FIG. 2 is a front view of the adaptor of FIG. 1 illustrating features thereof in accordance with certain principles of the invention.

Referring now to FIGS. 2, 3 and 4, adaptor 16 is formed in a generally cylindrical shape from a single piece of metal of substantially uniform thickness such as, for example, steel. Adaptor 16 is formed with a large cylinder 22 extending from one side thereof and a smaller cylinder 24 extending from the opposite side thereof. Cylinders 22 and 24 are in axial alignment and are formed with communicating axial openings 23 and 25, respectively. Cylinder 22 is integrally joined at an inboard end thereof with an inner link 26 while cylinder 24 is integrally joined with at an inboard end thereof with an inner link 28. Inner links 26 and 28 are, in turn, integrally joined together at a folded link 30. Cylinder 22 is formed with a pair of diametrically opposite radial cutouts 32 and cylinder 24 is similarly formed with a pair of diametrically opposite radial cutouts 34.

Figure 5:
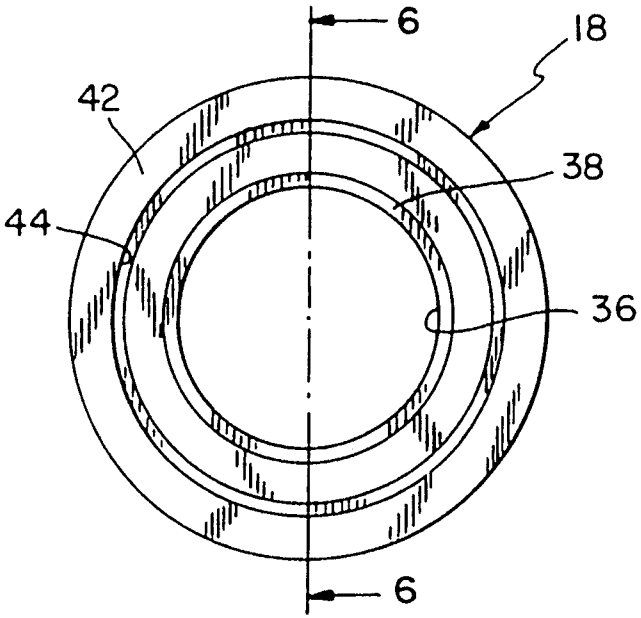
FIG. 5 is a rear view of a guard collar.
Figure 6:
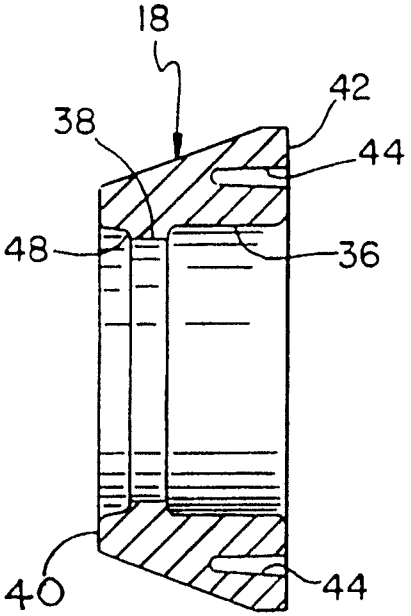
FIG. 6 is a sectional view taken along line 6—6 of FIG. 5 illustrating features of the guard collar of FIG. 5.

As shown in FIGS. 5 and 6, guard collar 18 is generally cylindrical. Guard collar 18 is formed with a cylindrical opening 36 with an internal annular rib 38 having a diameter selected for receipt of cylinder 20 in the manner shown in FIG. 7. Guard collar 18 is also formed with an outboard face 40 and an inboard face 42. A circular groove 44 is formed in inboard face 42.

As shown in FIG. 1, the exterior diameter of cylinder 24 is selected to fit into hole 12 and is, therefore, slightly less than one and one-half inches. The exterior diameter of cylinder 22 is selected to fit into hole 14 and is, therefore, slightly less than two and one-eighth inches.

The width of groove 44 of guard collar 18 is slightly greater than the thickness of the material used to form adaptor 16 while the diameter of the groove is consistent with the diameter of cylinder 22. In this manner, cylinder 22 fits into groove 44 when adaptor 16 is assembled with the smaller hole 12. Cylindrical opening 36 of guard collar 18 is formed with a diameter which receives cylinder 24. The inner diameter of cylinder 24 is of sufficient dimension to allow cylinder 20 to be fully inserted within collar 18 in the instance where adaptor 16 is assembled with larger hole 14. In such assembly, it is noted that a flange 46 (FIG. 1) of cylinder 20 will engage an outboard face 48 of guard collar 18 to limit the inward position of the cylinder.

Figure 7:
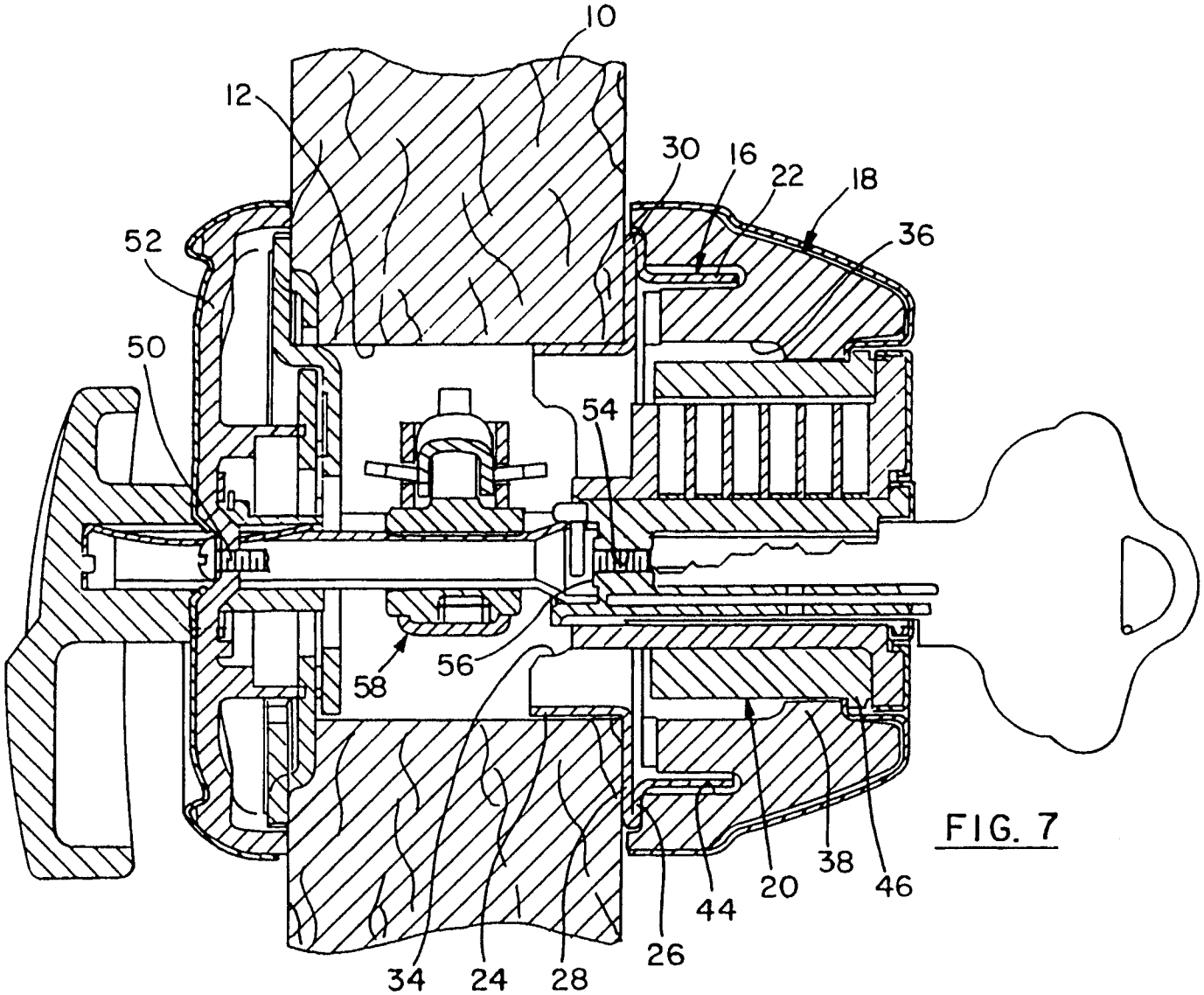
FIG. 7 is a sectional view of an assembly of various components of a deadbolt assembly showing the adaptor in position in accordance with certain principles of the invention.

Referring to FIG. 7, door 10 is formed with smaller hole 12 and the user desires to install a deadbolt assembly therewith. In this instance, cylinder 24 of adaptor 16 is inserted into hole 12 and cylinder 22 of the adaptor is located within groove 44 of guard collar 18. Lock cylinder 20 is positioned within opening 36 of collar 18. A pair of screws 50 (one shown) are positioned through holes in a rose liner 52 from the opposite side of door 10. The threaded ends of the screws 50 are inserted into threaded holes 54 (one shown) formed in an inboard face 56 of lock cylinder 20. The screws 50 are drawn tight to hold the assembly as illustrated in FIG. 7 in general axial alignment. However, it is possible that, without the use of adaptor 16, collar 18 and other lock components could shift laterally with respect to the adjacent face of door 10.

Cylinder 24 is confined within hole 12 of door 10 and is precluded from shifting in any radially lateral direction relative to the axis of the hole. Thus, cylinder 24 forms a first structural section of adaptor 16, or a means thereof, for precluding lateral movement of the adaptor relative to the axis of the hole. Cylinder 22 is confined within groove 44 and thereby prevents movement in any radially lateral direction of guard collar 18 relative to the axis of cylinder 22. Thus, cylinder 22 forms a second structural section of adaptor 16, or a means thereof, for preventing movement in any lateral direction relative to the second structural element.

Cylinders 22 and 24 are joined together through the integral structure of links 26, 28 and 30 which combine to form a third structural section, or structural link, of adaptor 16, or means, for linking together cylinders 22 and 24. In this manner, the precluding of movement in any radially lateral direction of cylinder 24 relative to the axis of hole 12 is coupled to cylinder 22 which thereby prevents movement of guard collar 18 in any radially lateral direction relative to the axis of hole 12.

Radial cutouts 34 of cylinder 24, as shown in FIG. 7, provide a clearance for a bolt actuation means 58. In similar fashion, when cylinder 22 is assembled within hole 14, cutouts 32 provide clearance for bolt actuation means 58.

When the hole of door 10 is the larger size, cylinder 22 is inserted into hole 14 (FIG. 1). Cylinders 22 and 24 assume reverse roles from that described above with respect to cylinder 24 being inserted into hole 12 (FIG. 7). The principles of this invention, however, remain the same as that described above. In the latter instance, cylinder 22 becomes the first structural section and cylinder 24 becomes the second structural section.

Further, in the illustrated embodiment, cylinders 22 and 24 fit into groove 44 and cylindrical opening 36 of guard collar 18, respectively, to function as the second structural section. In each position, either cylinder 22 or cylinder 24 is positionable adjacent guard collar 18 to prevent movement of the collar in any radial direction relative to the axis of the respective hole 14 or 12. Any positioning of cylinders 22 or 24 adjacent to guard collar 18 in a manner other than as described above which will preclude the radially lateral movement of the collar accomplishes this function in accordance with the principles of this invention. For example, cylinder 22 could be positioned about the outer periphery of guard collar 18 and thereby prevent radial movement of the collar.

Also, in the illustrated embodiment, cylinders 22 and 24 are of cylindrical configuration to conform to the size and shape of holes 12 and 14. Holes 12 and 14 could be formed in a configuration other than cylindrical such as, for example, square, rectangle, etc. In such instance, cylinders 22 and 24 would be formed in a structural configuration to mate with the shape of holes 12 and 14 without departing from the spirit and scope of the invention. Further, cylinders 22 and 24 could be formed in a structural configuration which is less than the configuration of the holes 12 and 14 without departing from the spirit and scope of this invention. For example, while holes 12 or 14 are cylindrical, each of the sections replacing cylinders 22 and 24 could be quarter-round, opposing panels extending into opposite facing sides of the hole. Or if holes 12 and 14 were square, the replacement sections could be flat facing panels which cover completely facing sidewalls of the square hole.

In general, the above-described embodiments are not to be construed as limiting the breadth of the present invention. Modifications, and other alternative constructions, will be apparent which are within the spirit and scope of the invention as defined in the appended claims.

What is claimed is:

1. A reversible adaptor for facilitating the assembly of a component of a lock assembly with a door to preclude axially lateral movement of the assembled component where the door is formed with a hole of a first prescribed shape or a hole of a second prescribed shape different from the first prescribed shape, which comprises:

a first structural section formed in a shape having at least portions complementary to the first prescribed shape for insertion into the hole of the first prescribed shape;

a second structural section formed in a shape having at least portions complementary to the second predetermined shape for insertion into the hole of the second prescribed shape;

a third structural section formed integrally with and between the first and second structural sections for linking together the first and second structural sections; and the component formed in one face with structure for receipt of the first or second structural sections;

wherein, when the first structural section is located in the hole of the door, the second structural section extends outwardly from a plane in which the face of the door is located and into the structure of the component and, when the second structural section is located in the hole of the door, the first structural section extends outwardly from the plane in which the face of the door is located and into the structure of the component.

2. The adaptor as set forth in claim 1 wherein the first structural section is in the form of a cylinder.

3. The adaptor as set forth in claim 1 wherein the second structural section is in the form of a cylinder.

4. The adaptor as set forth in claim 1 wherein the third structural section comprises a folded link integrally joined with the first and second structural sections.

5. The adaptor as set forth in claim 1 wherein the first structural section comprises spaced portions which form fit within the hole and engage associated portions of the door to preclude lateral movement of the spaced portions relative to the axis of the hole.

6. The adaptor as set forth in claim 1 wherein the second structural section comprises spaced portions which engage associated portions of the component to prevent lateral movement of the component relative to the spaced portions.

7. The adaptor as set forth in claim 1 wherein the component has a groove formed therein and the third structural section is received within the groove.

8. The adaptor as set forth in claim 7 wherein the groove comprises an annular section and the third structural section comprises an annular section of said adaptor received within and substantially complementing an associated portion of the annular groove.

9. An adaptor as set forth in claim 8 wherein the component comprises a guard collar.

10. An adaptor as set forth in claim 1 wherein said third structural section comprises a folded link having a radially outwardly extending annular flange defining the major diameter of said adaptor.

11. A reversible adaptor for mounting a guard collar generally adjacent a face of a door externally thereof where the door is formed with a cylindrical hole wherein axially normal to and opening through the face and formed with a first diameter or a second diameter different from the first diameter, the guard collar defining a first cylindrical space having a diameter generally the same as the first diameter of the cylindrical hole of the door and a second cylindrical space having a diameter generally the same as the second diameter of the cylindrical hole of the door, said adaptor comprising a first cylindrical tubular section having an outside diameter generally equal to the first diameter of the hole in the door, a second cylindrical tubular section having an outside diameter generally equal to the second diameter of the hole of the door and coaxially aligned with said first cylindrical tubular section, and a generally radially outwardly directed annular flange integrally connected to and joining said first cylindrical tubular section and said second cylindrical tubular section, said annular flange defining the major diameter of said adaptor, wherein when the hole of the door is formed with the first diameter the first cylindrical tubular section is located within the hole and the second cylindrical tubular section is located within the second cylindrical space of the guard collar and when the hole of the door is formed with the second diameter the second cylindrical tubular section is located within the hole and the first cylindrical tubular section is located within the first cylindrical space of the guard collar.

12. A unitary adaptor as set forth in claim 11, wherein said first cylindrical tubular section has an outside diameter which differs from the outside diameter of said second cylindrical tubular section.

13. A unitary adaptor as set forth in claim 12 wherein said adaptor is made from metal of substantially uniform thickness.

14. A unitary adaptor as set forth in claim 13 wherein said annular flange is formed by two layers of metal folded into face-to-face relation to each other.

* * * * *